US006327226B1

(12) United States Patent
Russi

(10) Patent No.: US 6,327,226 B1
(45) Date of Patent: Dec. 4, 2001

(54) CLOCK WITH CAM DEVICE

(76) Inventor: Luca Russi, Via Gentile, 63/D, I-70126 Bari (IT)

( * ) Notice: Subject to any disclaimer, the term of this patent is extended or adjusted under 35 U.S.C. 154(b) by 0 days.

(21) Appl. No.: 09/381,493

(22) PCT Filed: Mar. 17, 1998

(86) PCT No.: PCT/EP98/01527

§ 371 Date: Sep. 21, 1999

§ 102(e) Date: Sep. 21, 1999

(87) PCT Pub. No.: WO98/43137

PCT Pub. Date: Oct. 1, 1998

(30) Foreign Application Priority Data

Mar. 21, 1997 (IT) ..... BA97A0013

(51) Int. Cl.[7] ..... G04B 19/04

(52) U.S. Cl. ..... 368/228; 368/238; 368/80; 368/124

(58) Field of Search ..... 368/124, 228–238, 368/80

(56) References Cited

U.S. PATENT DOCUMENTS

| | | | | |
|---|---|---|---|---|
| 1,350,131 | | 8/1920 | Anderson . | |
| 1,465,045 | | 8/1923 | Kern . | |
| 1,989,584 | * | 1/1935 | Biedenfeld | 368/238 |
| 3,696,609 | * | 10/1972 | Dubois | 368/220 |

* cited by examiner

*Primary Examiner*—Bernard Roskoski
(74) *Attorney, Agent, or Firm*—Alston & Bird LLP

(57) ABSTRACT

To the spindles of the mechanism (1) of a wall clock or a table clock are mounted, in substitution of the hands, two couples of cams (8, 9 and 6, 7) which transmit respectively to hands (11 and 12) of the minutes and the hours rotating around a spindle (18), an anti-clockwise direction movement different from the ones of the mechanism (1) on a 120° circular sector instead of on a clock-face. The sector is graduated in order to indicate the hours along an arc of twelve hours and 60 minutes.

12 Claims, 3 Drawing Sheets

CLOCK WITH CAM DEVICE

The invention deals with a new device, which changes the rotary movement of the hands of a clock into an alternate movement along a 120° arc.

Its consists especially in a device particularly suitable to be applied to an ornamental table clock or a wall clock, making the rotation of the hands of the hours and minutes different from the traditional one based on the use of gears.

Figure 2:
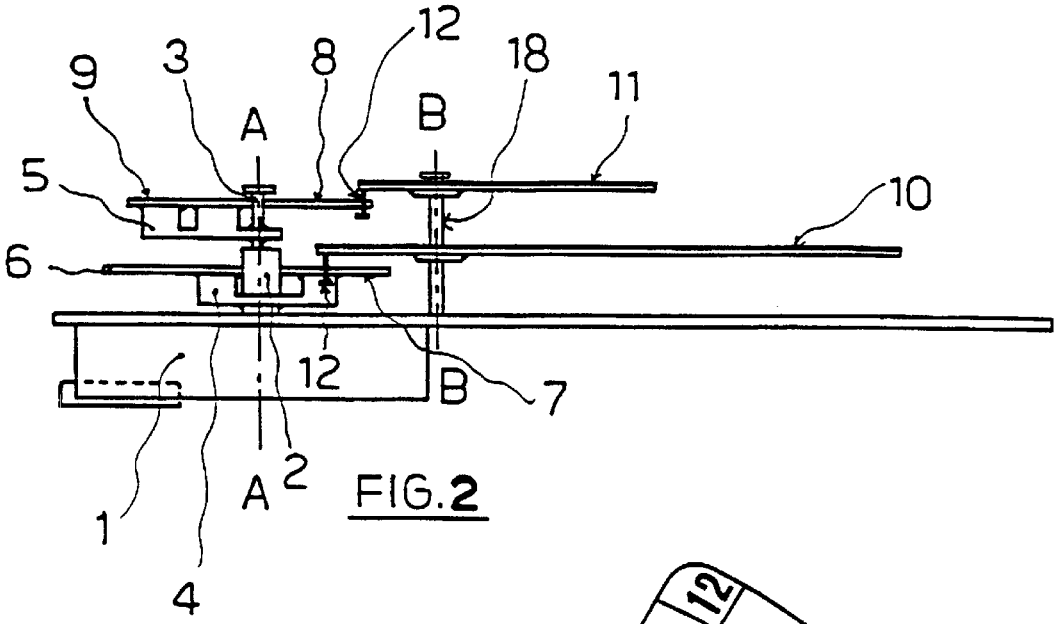
Figure 1:
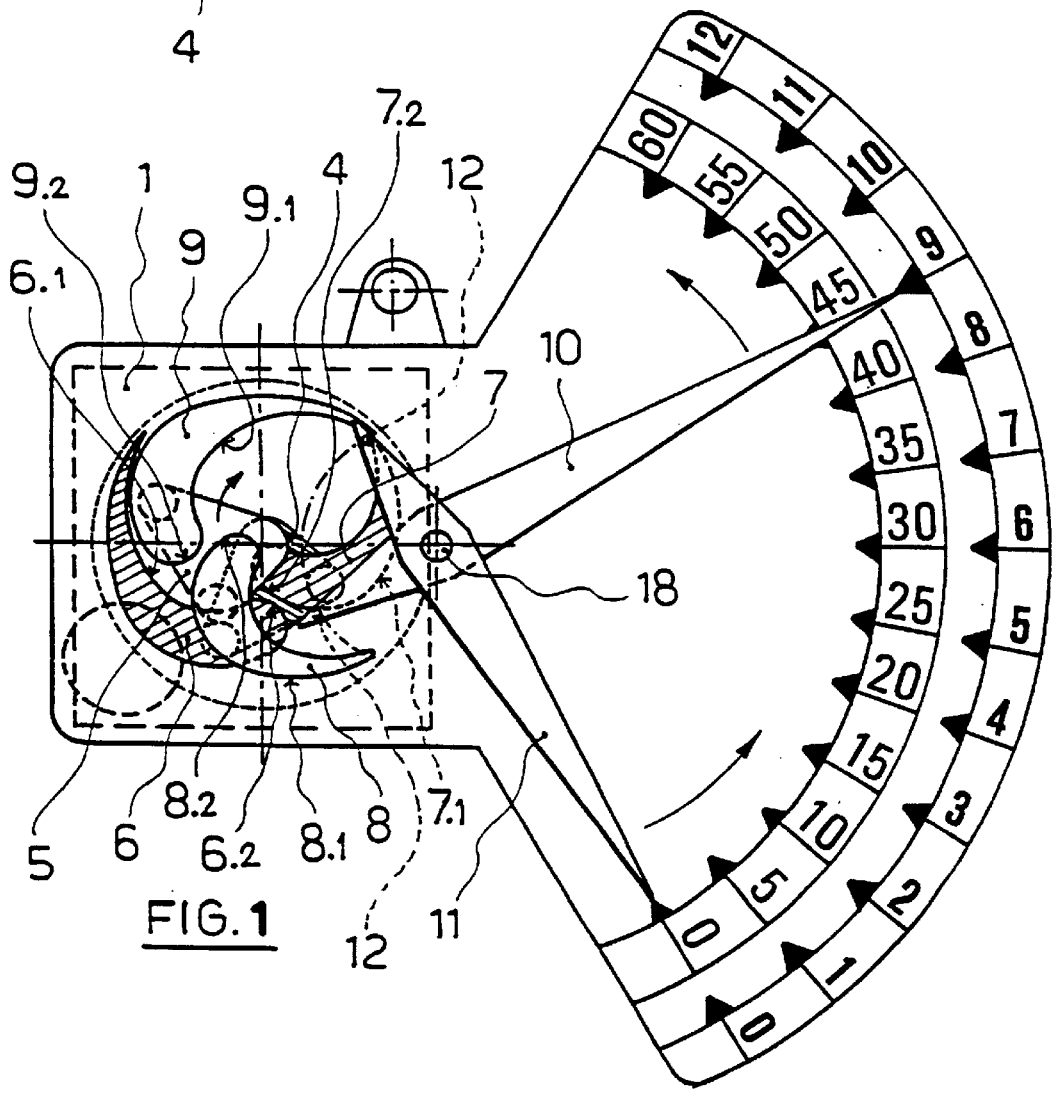
Figure 5:
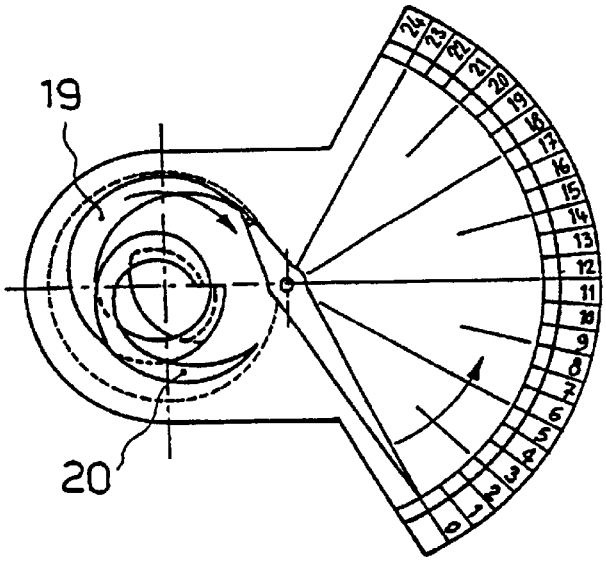
Figure 4:
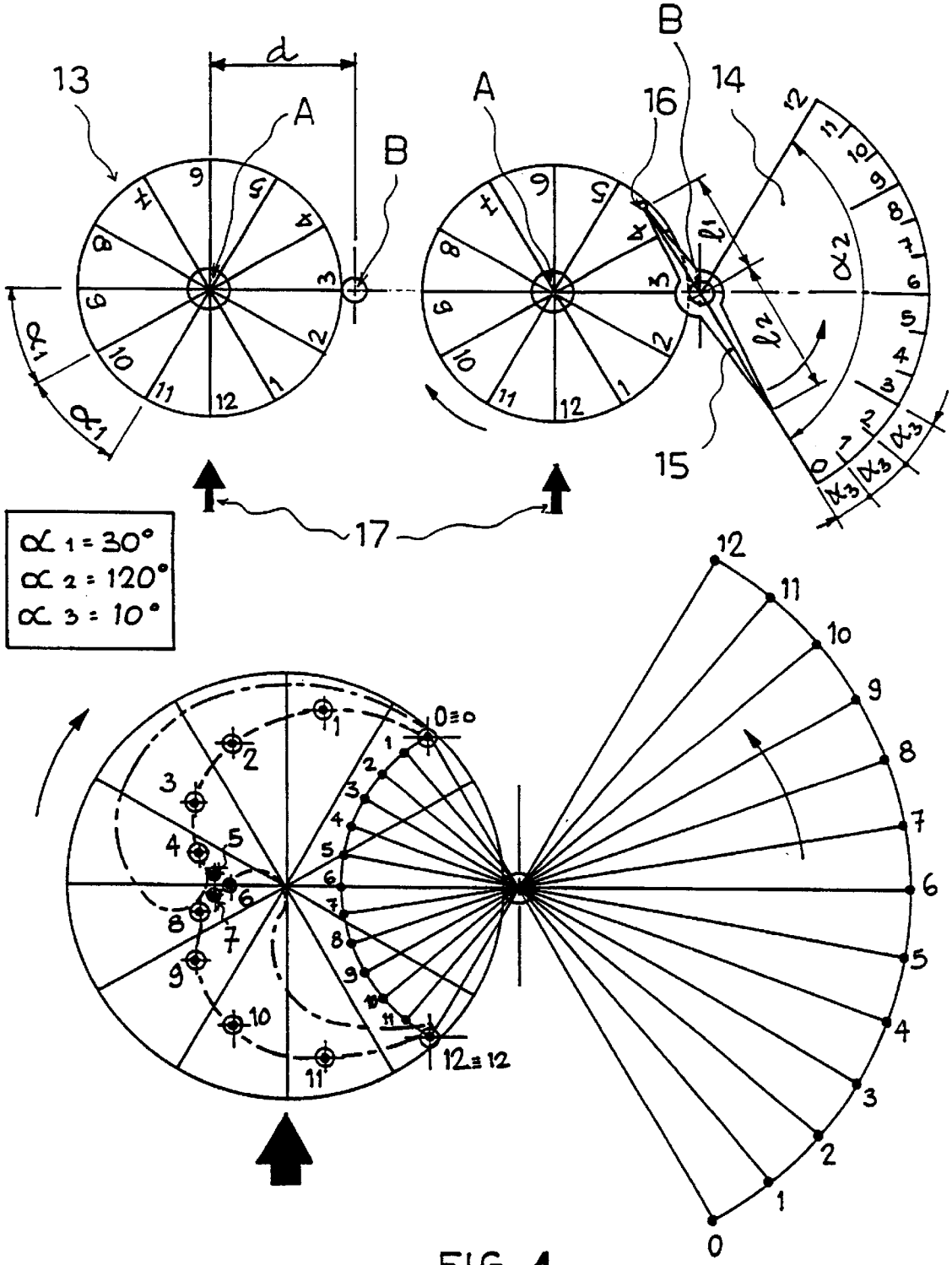

The invention is described here below in a preferred embodiment with the help of the figures herewith enclosed, which illustrate respectively:

FIG. 1, an upper view of a clock provided with the device according to the invention;

FIG. 2, a side view of FIG. 1;

FIG. 3, some phases of the working of the device;

FIG. 4, the set which permits the drawing of the contour of the cams forming the device;

FIG. 5, the cams for the driving of the hand of the hours on a 120–° arc divided in 24 hours.

The invention includes essentially a common mechanism of a traditional clock and the couple of coaxial spindle 2 and 3 on which the hands of the hours and the minutes are usually connected On each one of said spindle 2 and 3 and in substitution of the hands, is connected a base provided with a normal bearing surface at the axis of the spindles themselves, on each of them a couple of flat cams which are laying on the same plane is applied: more particularly on spindle 2 is connected the base 4 on which cams 6 and 7 are superimposed and on spindle 3 is connected the base 5, on which cams 8 and 9 are integral with The hands indicating the time are thus driven from said couples of cams: especially cams 6 and 7 drive the hand 10 of the hours and cams 8 and 9 drive the hand 11 of the minutes, both of them rotating around the axis B of the spindle 18 instead of rotating around the axis A of the spindles 2 and 3.

At this end, said couples of cams lead during their rotation some pins 12 provided with rim, applied on the extremity of the hands 10 and 11 opposed to the ones, which indicate the time.

The pins, having a normal vertical axis on the plane of the laying of the cams and the hands, run in fact along the inner contours 6.1 and 9.1 of the big cams and along the outer contours of the small cams.

In order to permit the transit of the pins 12 form the inner contours to the outer ones, the contours 6.2, 9.2 and 7.2, 8.2 of each couple of cams are spaced out in the zone in which they are opposed and are shaped in order to permit the transit from the inner contour of a cam to the outer one from the adjacent cam, without any discontinuity.

In other words, pin 12, applied on hand 10 of the hours, runs initially along the inner edge 6.1 of the cam 6 and afterwards, without any discontinuity, along the outer edge 7.1 of the cam 7, passing on the opposed edges 6.2 and 7.2; pin 12, applied on hand 11 of the minutes, runs on the contrary in a first time along the outer edge 9.1 of cam 9 and, in a second time, along the outer edge 8.1 of cam 8, passing between the opposed edges 9.2 and 8.2 of cams 9 and 8.

As the hands have to run alternatively on a 120–° arc, the contour of the cams is shaped in order to cause a reduction of the angular speed of the hands equal to a third of the one of the small shafts 2 and 3 of the mechanism of the clock on which are connected the respective bases 4 and 5. Besides, the contour of the cams are shaped in order to cause the return of the hands from the end of the scale to their initial position as soon as the same arrive in correspondence with said end of the scale.

Figure 3A:
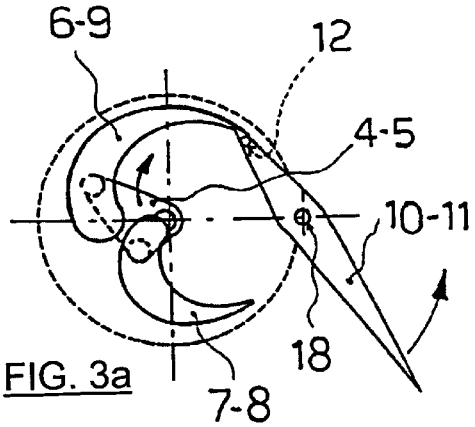
Figure 3C:
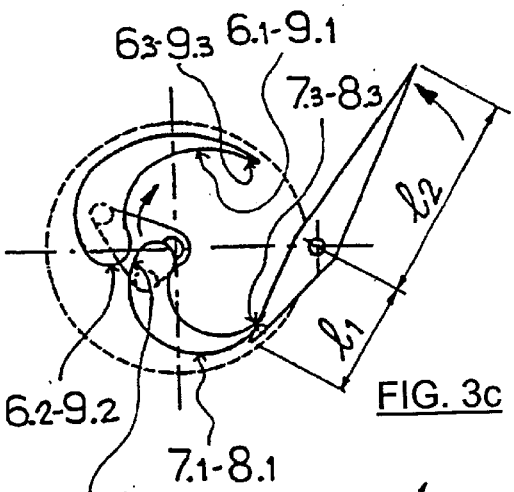
Figure 3B:
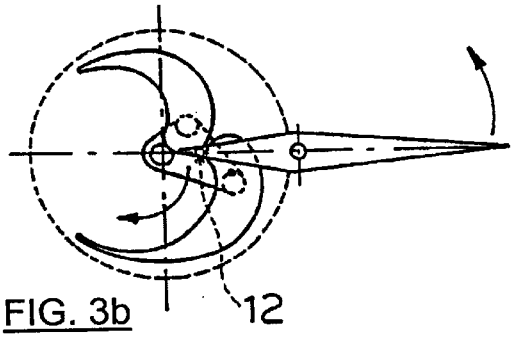
Figure 3D:
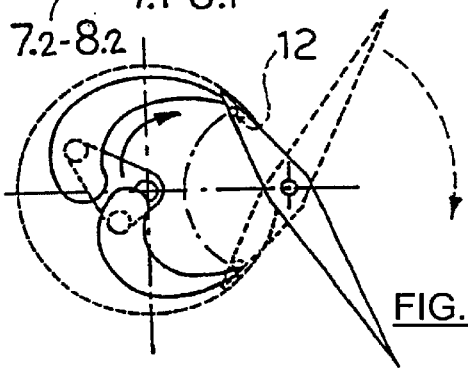

The return of the hands in the positions of 0 hour and 0 minute happens per gravity, see FIGS. 3*c* and 3*d*, each time the pin 12 leaves the extremities 9, 7.3 and 8.3 of the cams 7 and 8, as a result of the superior weight of this part of the hands 10 and 11 with a length 12 included between the spindle 18 and the end which indicates the time.

The drawing of the inner and outer contour of the cams can be empirically realised per point on the basis of the angular excursion the hands 10 and 11 have to do along the 120–° arc.

At this end, (FIG. 4), we define in a fist step on the basis of the desired dimensions of the mechanism the distance "d" between the axis A of the coaxial spindle of the mechanism of the clock and the axis B around which the hands have to run effectively.

On the axis, a disk 13, having a radius a little less inferior to said distance "d", divided in 12 circular sectors wide 30–°, numerated in antilockwise direction from 1 to 12, is applied by means of a sharp spindle.

The centre of a circular 120–° sector 14, which will be divided by the prolongation of the horizontal straight line connecting the two axes A and B in two identical 120–° sectors, is superimposed at the axis B; the circular sector is divided with 13 notches numerated from 0 to 12 in anti-clockwise direction, in twelve segments 10° wide.

In a second step, on the track of the axis B, a rod 15 is applied by the means of a spindle which divides it in two parts having a length L1 and L2 where L1 is less than L2.

The extremity of the rod which has a length of L2 must indicate the hours and the minutes marked on the circular sector, while the opposed extremity with a length L1 supplied with a hollow eyelet 16 in which the nib of a "grafos" or the extremity of a pencil is inserted The length L1 of the rod has to be inferior to the distance d between the tracks A and B of the two axis so that the eyelet 16 can rotate inside the ga ted disk 13, to the right of the track of the axis A.

That being stated, after having rotated the disk 13 in clockwise direction so that the notch of time 12 goes in correspondence of the outer reference point indicated by needle 17 and after having put the pointer of the extremity of the rod 15 on time 0:00 of the circular sector 14, we mark the first point of the cams contour.

The other points of the cams contour are obtained by rotating the disk 13 in a clockwise direction of 30° per time as respect to the reference notch 17 and the rod 15 of 10° per time in an antilockwise direction, marking in the meanwhile on disk 13 the points corresponding to the hours indicated on the opposed extremities of the rod.

By the means of these points, we draw the curvilinear contours of the cams which the pin 12 has to feel, in order to cause the hands rotation in the 120° sector at a speed which is the third of the one of the couple of cams, i.e. the inner contours 6.1 and 9.1 and the outer contours 7.1 and 8.1 of the superimposed couples of cams.

In another embodiment of the invention, the contours of the couples of cams 19 and 20 (FIG. 5) only drive the hand of the hours for a 24 hours period on a 120° arc.

In another embodiment, the clock can be provided with the seconds' hand. In this case, the mounting of a third couple of cams on the small shaft which is assigned to the rotation of said hand is necessary.

What is claimed is:

1. A clock comprising a clock mechanism having a rotating hour spindle and a rotating minute spindle, an hour hand and a minute hand each mounted for rotation about an axis different from the axis of said hour spindle and said minute spindle, a couple of cams associated with each said spindle and mounted for movement in response to rotation of the respective spindle, a pin connected to each said hand and being mounted to follow said couple of cans and to thereby impart movement of the respective hand through an arc to indicate time.

2. A clock according to claim 1, wherein said pin is mounted for movement along the inner contours of a first one of said cams and along the outer contours of the other one of said cams.

3. A clock according to claim 1, wherein said hour spindle and said minute spindle are coaxial, and wherein said hour hand and said minute hand are mounted for rotation about a common axis different from said coaxial spindle axis.

4. A clock according to claim 1, wherein one end of each of hands is adapted to indicate time, and wherein said pin is connected to the opposite end of the hand.

5. A clock according to claim 4, additionally including an arcuate plate positioned adjacent the time indicating ends of said hands, and including a first series of indicia at arcuately spaced locations for indicating hours and a second series of indicia at arcuately spaced locations for indicating minutes.

6. A clock according to claim 5, wherein said first and second series of indicia extend through an arc of approximately 120 degrees.

7. A device to change the rotary movement of the hands of a clock into an alternate movement, the device being operable with a common clock mechanism having spindles rotating at the speed of hours and minutes, said device comprising at least two cams which are adapted to be associated with each said spindle and mounted to respond to rotation of the respective spindle, an hour hand and a minute hand each mounted for rotation about an axis different from the axis of spindles of the clock mechanism, a pin connected to each said hand and being mounted to follow said couple of cams and to thereby impart movement of the respective hand through an arc to indicate time.

8. A device according to claim 7, wherein said pin is mounted for movement along the inner contours of a first one of said cams and along the outer contours of the other one of said cams.

9. A device according to claim 7, wherein said hour spindle and said minute spindle are coaxial, and wherein said hour hand and said minute hand are mounted for rotation about a common axis different from said coaxial spindle axis.

10. A device according to claim 7, wherein one end of each of hands is adapted to indicate time, and wherein said pin is connected to the opposite end of the hand.

11. A device according to claim 10, additionally including an arcuate plate positioned adjacent the time indicating ends of said hands, and including a first series of indicia at arcuately spaced locations for indicating hours and a second series of indicia at arcuately spaced locations for indicating minutes.

12. A device according to claim 11, wherein said first and second series of indicia extend through an arc of approximately 120 degrees.

* * * * *